US005868478A

United States Patent [19]

Yemini

[11] Patent Number: 5,868,478

[45] Date of Patent: Feb. 9, 1999

[54] COMBINED HANDLE-SECURING ARRANGEMENT

[75] Inventor: Zvi Yemini, Tel Aviv, Israel

[73] Assignee: ZAG Industries Ltd., Rosh Haayin, Israel

[21] Appl. No.: 980,767

[22] Filed: Dec. 1, 1997

[51] Int. Cl.[6] ..... A47B 88/00

[52] U.S. Cl. ..... 312/332.1; 312/333; 292/107; 292/114

[58] Field of Search ..... 312/332.1, 330.1, 312/333, 215, 222; 292/107, 113, 114, 121, 95, DIG. 30

[56] References Cited

U.S. PATENT DOCUMENTS

| | | | |
|---|---|---|---|
| 4,106,239 | 8/1978 | Bancroft et al. | 292/114 X |
| 5,292,191 | 3/1994 | Slivon | 312/332.1 |
| 5,388,902 | 2/1995 | Huebschen et al. | 312/333 X |
| 5,413,409 | 5/1995 | Arai | 312/330.1 |

FOREIGN PATENT DOCUMENTS

| | | | |
|---|---|---|---|
| 414948 | 6/1925 | Germany | 292/107 |
| 2503272 | 8/1975 | Germany | 292/107 |
| 1020266 | 2/1966 | United Kingdom | 312/332.1 |

*Primary Examiner*—Peter M. Cuomo
*Assistant Examiner*—James O. Hansen
*Attorney, Agent, or Firm*—Mark M. Friedman

[57] ABSTRACT

A combined handle-securing arrangement for unsecuring and opening a drawer in a cabinet and for closing and securing the drawer in the cabinet by a single action, and a drawer-cabinet including the combined handle-securing arrangement. The combined handle-securing arrangement including (a) a substantially L-shaped element having a first arm and a second arm being connected therebetween to form the substantially L-shaped element, the first arm being disposed substantially along a frontal face of the drawer, the second arm being disposable above the drawer, the L-shaped element being hingedly attachable to the drawer via a hinge, the hinge being located about a connection region of the first and second arms, the second arm being formed with a securing mechanism for accommodating an edge element of the cabinet; and (b) a spring element being connected to the second arm of the L-shaped element, the spring element being disposable against a contra element being connected to the drawer, such that when the drawer is closed the spring element forces together the edge element of the cabinet and the securing mechanism of the second arm, thereby securing the drawer closed, whereas when a user pulls the first arm away from the face of the drawer against a force imposed by the spring element, the L-shaped element rotates about the hinge, so as to separate the edge element of the cabinet and the securing mechanism of the second arm, thereby the drawer may become unsecured and concomitantly openable.

10 Claims, 3 Drawing Sheets

COMBINED HANDLE-SECURING ARRANGEMENT

FIELD AND BACKGROUND OF THE INVENTION

The present invention relates to a handle and SECURING arrangement and, more particularly, to a combined handle-securing arrangement.

A handle is used for opening and closing a drawer in a cabinet by slideably pulling or pushing the drawer along suitable rails present in the cabinet.

A securing arrangement is used to secure the drawer in its closed situation.

Thus, when a user wishes to open a drawer, the user must first to unsecure the securing arrangement and then to pull the drawer's handle in order to open the drawer.

When the user wishes to close a drawer, the user must first to push the drawer via the handle and then to secure the drawer closed using the drawer's securing arrangement.

Thus both opening a secured drawer and closing and securing an opened drawer require two independent actions.

There is thus a widely recognized need for, and it would be highly advantageous to have, a combined handle-securing arrangement which enables unsecuring and opening a drawer and/or closing and securing a drawer in a single action.

SUMMARY OF THE INVENTION

According to the present invention there are provided a combined handle-securing arrangement for unsecuring and opening a drawer in a cabinet and for closing and securing the drawer in the cabinet by a single action, and a drawer-cabinet including the combined handle-securing arrangement.

According to further features in preferred embodiments of the invention described below, the combined handle-securing arrangement comprising (a) a substantially L-shaped element having a first arm and a second arm being connected therebetween to form said substantially L-shaped element, said first arm being disposed substantially along a frontal face of the drawer, said second arm being disposable above the drawer, said L-shaped element being hingedly attachable to the drawer via a hinge, said hinge being located about a connection region of said first and second arms, said second arm being formed with a securing mechanism for accommodating an edge element of the cabinet; and (b) a spring element being connected to said second arm of said L-shaped element, said spring element being disposable against a contra element being connected to the drawer, such that when the drawer is closed said spring element forces together the edge element of the cabinet and said securing mechanism of said second arm, thereby securing the drawer closed, whereas when a user pulls said first arm away from the face of the drawer against a force imposed by said spring element, said L-shaped element rotates about said hinge, so as to separate the edge element of the cabinet and said securing mechanism of said second arm, thereby the drawer may become unsecured and concomitantly openable.

According to further features in preferred embodiments of the invention described below, the drawer-cabinet comprising (a) a cabinet frame formed with at least one opening for slideably accepting at least one drawer, each of said at least one opening having an edge element; (b) at least one drawer being slideably accommodated within said at least one opening, each of said at least one drawers having a frontal face and being formed with a contra element; and (c) a handle-securing arrangement including (i) a substantially L-shaped element having a first arm and a second arm being connected therebetween to form said substantially L-shaped element, said first arm being disposed substantially along said frontal face of said drawer, said second arm being disposed above said drawer, said L-shaped element being hingedly attached to said drawer via a hinge, said hinge being located about a connection region of said first and second arms, said second arm being formed with a securing mechanism for accommodating said edge element of said cabinet; and (ii) a spring element being connected to said second arm of said L-shaped element, said spring element being disposed against said contra element of said drawer, such that when said drawer is closed said spring element forces together said edge element of said cabinet and said securing mechanism of said second arm, thereby securing said drawer closed, whereas when a user pulls said first arm away from said face of said drawer against a force imposed by said spring, said L-shaped element rotates about said hinge, so as to separate said edge element of said cabinet and said securing mechanism of said second arm, thereby the drawer unsecures and concomitantly opens.

According to still further features in the described preferred embodiments said second arm includes a far end, said far end being curved, so as to permit smooth closing of said drawer.

According to still further features in the described preferred embodiments said securing mechanism is a groove.

According to still further features in the described preferred embodiments said first and second arms and said securing mechanism of said L-shaped element, said spring element and said hinge are all integrally formed with one another.

According to still further features in the described preferred embodiments said drawer further includes a stopper to limit the rotation of said L-shaped element about said hinge.

The present invention successfully addresses the shortcomings of the presently known configurations by providing a combined handle-securing arrangement, and a drawer-cabinet including the combined handle-securing arrangement for unsecuring and opening a drawer in the cabinet and for closing and securing the drawer in the cabinet by a single action.

BRIEF DESCRIPTION OF THE DRAWINGS

The invention herein described, by way of example only, with reference to the accompanying drawings, wherein.

DESCRIPTION OF THE PREFERRED EMBODIMENTS

The present invention is of a combined handle-securing arrangement which can be used for unsecuring and opening a drawer in a cabinet and for closing and securing the drawer in the cabinet.

Specifically, the present invention can be used for unsecuring and opening the drawer in the cabinet and for closing and securing the drawer in the cabinet by a single combined action.

The principles and operation of a combined handle-securing arrangement according to the present invention may be better understood with reference to the drawings and accompanying descriptions.

Figure 1:
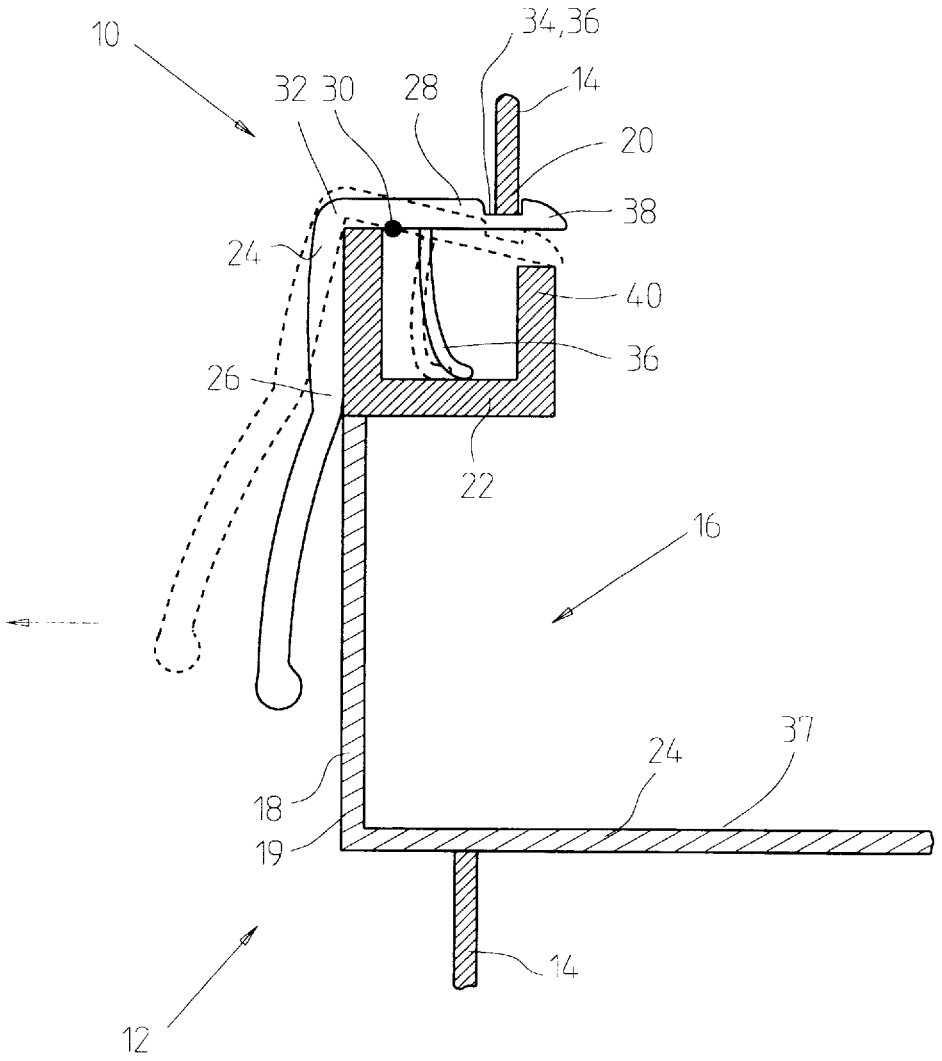
FIG. 1 is a cross section of the combined handle-securing arrangement of the present invention implemented in a drawer cabinet.
Figure 2:
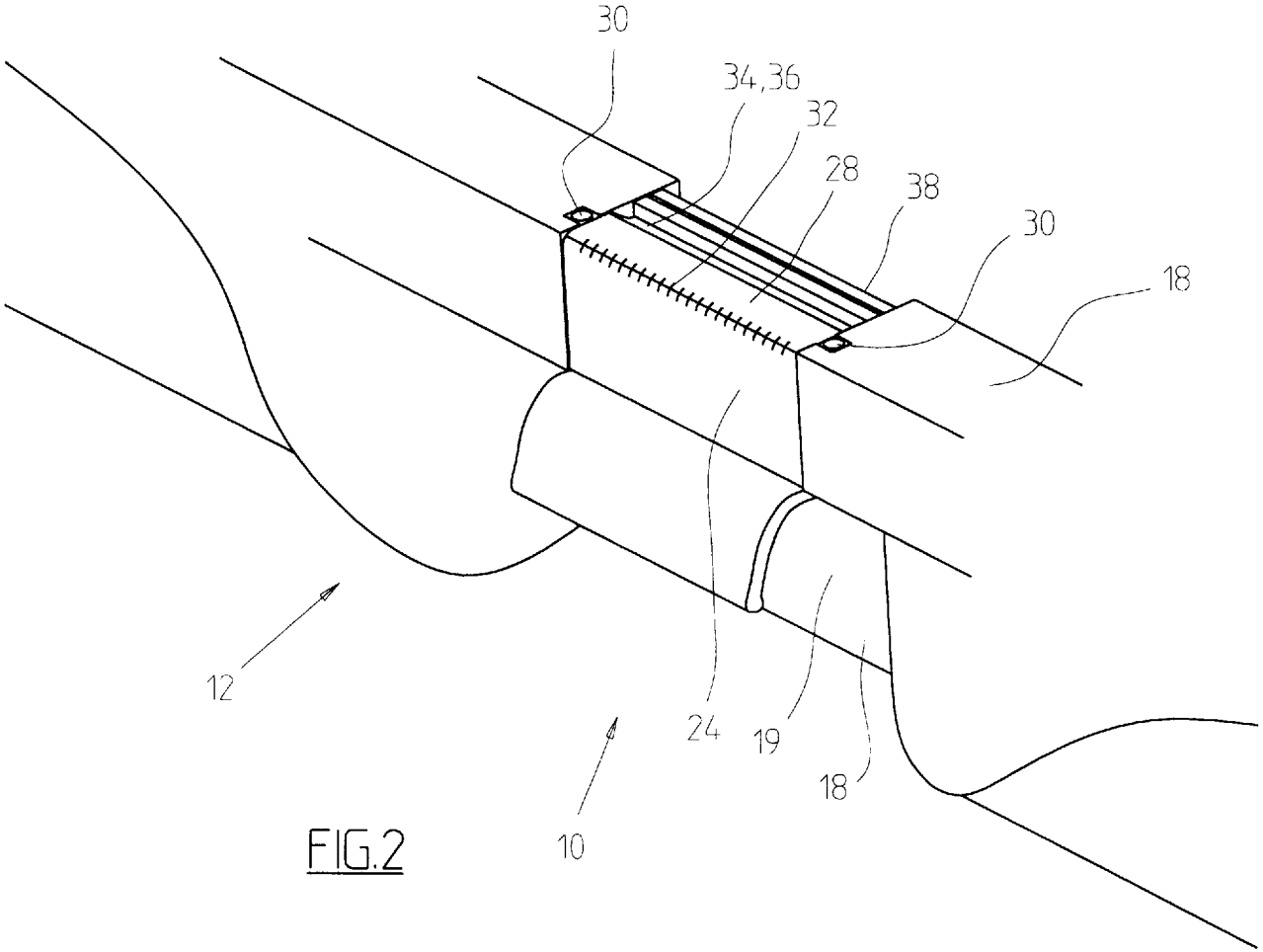
FIG. 2 is a perspective view of the combined handle-securing arrangement of the present invention implemented in a drawer.
Figure 3:
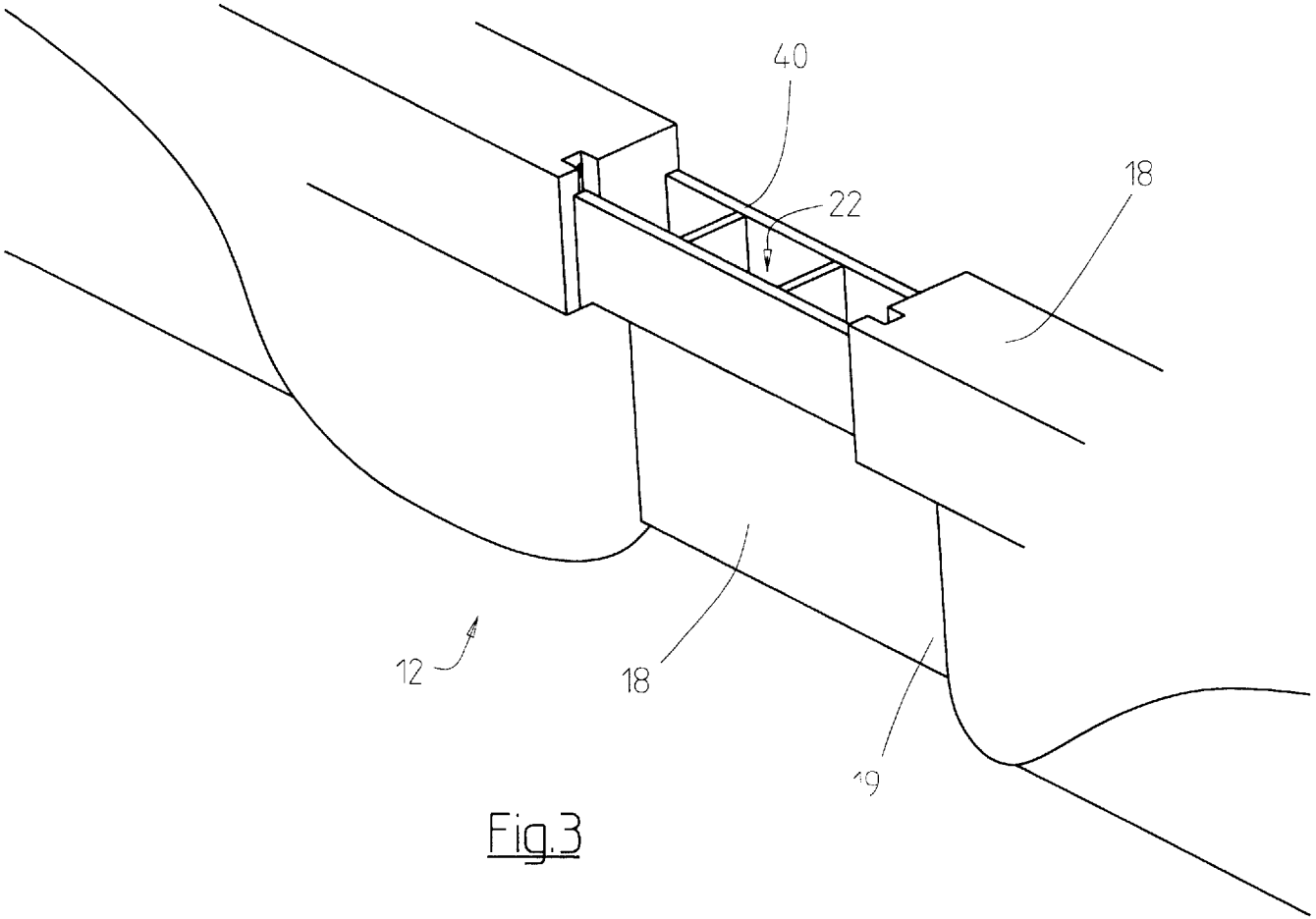
FIG. 3 is a perspective view of the drawer of FIG. 2 when the combined handle-securing arrangement is removed.

Referring now to the drawings, FIG. 1–3 illustrate the combined handle-securing arrangement, which is referred to herein below as arrangement 10, and its implementation in a drawer-cabinet 12.

Drawer-cabinet 12 includes a cabinet frame 14 formed with at least one opening 16 for slideably accepting at least one drawer 18.

As shown in FIG. 1, each of openings 16 includes an edge element 20.

The term drawer-cabinet as used herein in the specification and in the claims section below refers to any construction which includes drawers, such as, but not limited to, cabinet, drawer including portable box (e.g., tool box), etc.

Only a portion of cabinet frame 14 is shown in FIG. 1, however, it will be appreciated by one ordinarily skilled in the art that frame 14 may acquire a variety of constructions, sizes and shapes according to the specific application.

Drawer-cabinet 12 further includes at least one drawer 18. Drawer 18 is slideably accepted within opening 16. Drawer 18 has a frontal face 19. Drawer 18 is formed with a contra element 22, which is connected to or integrally formed with drawer 18. The functionality of contra element 22 is described below.

Drawer-cabinet 12 further includes a handle-securing arrangement 10. Arrangement 10 serves for unsecuring and opening drawer 18 and for closing and securing drawer 18 via a single combined action.

Arrangement 10 includes a substantially L-shaped element 24. Element 24 includes a first arm 26 and a second arm 28 which are substantially perpendicularly connected therebetween to form element 24.

First arm 26 is disposed substantially along frontal face 19 of drawer 18, whereas second arm 28 is disposable above drawer 18.

L-shaped element 24 is hingedly attached to drawer 18 via a hinge 30, which is rotatably accepted by hinge acceptors 31 formed in drawer 18. In a preferred embodiment of the invention hinge 30 is located about a connection region 32 of first 26 and second 28 arms.

Second arm 28 is formed with a securing mechanism 34 for accommodating edge element 20 of cabinet 14. In a preferred embodiment of the invention securing mechanism 34 is a groove 36 formed in the surface facing edge 20 of second arm 28. However, other possibilities exist, for example, mechanism 34 may be a protrusion (not shown) accepted by a groove (not shown) formed in edge element 20.

Furthermore, securing mechanism 34 may serve to secure additional components, such as, for example, a locking mechanism, thereby securing mechanism 34 serves also as a part of the locking mechanism.

Arrangement 10 further includes a spring element 36. Element 36 is connected to second arm 28 of L-shaped element 24. Spring element 36 is disposed against contra element 22 of drawer 18 such that when drawer 18 is closed, spring element 36 forces together edge element 20 of cabinet 14 and securing mechanism 34 of second arm 28, thereby securing drawer 18 closed. Whereas, when a user pulls first arm 26 of element 24 away from face 19 (as shown in a broken line in FIG. 1) of drawer 18, against the force imposed by spring element 36, L-shaped element 24 rotates about hinge 30, so as to separate edge element 20 of cabinet 20 and securing mechanism 34 of second arm 28, thereby drawer 18 unsecures and concomitantly opens.

It is clear from the above description that in some applications base 37 of drawer 18 may serve as contra element 22.

In a preferred embodiment of the invention second arm 28 includes a curved far end 38, so as to permit smooth closing of drawer 18, when arm as 26 flows under, and may therefore collide with edge 20 of cabinet 14.

In another preferred embodiment of the invention, drawer 18 further includes a stopper element 40 for limiting the rotation imposed on element 24, thereby protecting both hinge 30 and especially spring element 36 from being worn-out by aggressive users.

In yet another preferred embodiment of the invention first 26 and second 28 arms and securing mechanism 34 of L-shaped element 24, spring element 36 and hinge 30 are all integrally formed with one another and are preferably made of plastic.

The required relative rigidity of element 34 and the required relative flexibility of spring 36 are achieved in this case by selecting a suitable thickness and construction, e.g., rib construction for rigidity and thin flat construction for flexibility, all as is well known in the art of plastics.

While the invention has been described with respect to a limited number of embodiments, it will be appreciated that many variations, modifications and other applications of the invention may be made.

What is claimed is:

1. A combined handle-securing arrangement for unsecuring and opening a drawer in a cabinet and for closing and securing the drawer in the cabinet by a single action the combined handle-securing arrangement comprising:

(a) a substantially L-shaped element having a first arm and a second arm being connected therebetween to form said substantially L-shaped element, said first arm being disposed substantially along a frontal face of the drawer, said second arm being disposable above the drawer, said L-shaped element being hingedly attachable to the drawer via a hinge, said hinge being located about a connection region of said first and second arms, said second arm being formed with a securing mechanism for accommodating an edge element of the cabinet; and (b) a spring element being connected to said second arm of said L-shaped element, said spring element being disposable against a contra element being connected to the drawer, such that when the drawer is closed said spring element forces together the edge element of the cabinet and said securing mechanism of said second arm, thereby securing the drawer closed, whereas when a user pulls said first arm away from the face of the drawer against a force imposed by said spring element, said L-shaped element rotates about said hinge, so as to separate the edge element of the cabinet and said securing mechanism of said second arm, thereby the drawer may become unsecured and concomitantly openable.

2. The combined handle-securing arrangement of claim 1, wherein said second arm includes a far end, said far end being curved, so as to permit smooth closing of said drawer.

3. The combined handle-securing arrangement of claim 1, wherein said securing mechanism is a groove.

4. The combined handle-securing arrangement of claim 1, wherein said first and second arms and said securing mechanism of said L-shaped element, said spring element and said hinge are all integrally formed with one another.

5. The combined handle-securing arrangement of claim 1, wherein said drawer further includes a stopper to limit the rotation of said L-shaped element about said hinge.

6. A drawer-cabinet comprising:

(a) a cabinet frame formed with at least one opening for slideably accepting at least one drawer, each of said at least one opening having an edge element;

(b) at least one drawer being slideably accommodated within said at least one opening, each of said at least one drawers having a frontal face and being formed with a contra element; and (c) a handle-securing arrangement including:

(i) a substantially L-shaped element having a first arm and a second arm being connected therebetween to form said substantially L-shaped element, said first arm being disposed substantially along said frontal face of said drawer, said second arm being disposed above said drawer, said L-shaped element being hingedly attached to said drawer via a hinge, said hinge being located about a connection region of said first and second arms, said second arm being formed with a securing mechanism for accommodating said edge element of said cabinet; and (ii) a spring element being connected to said second arm of said L-shaped element, said spring element being disposed against said contra element of said drawer, such that when said drawer is closed said spring element forces together said edge element of said cabinet and said securing mechanism of said second arm, thereby securing said drawer closed, whereas when a user pulls said first arm away from said face of said drawer against a force imposed by said spring, said L-shaped element rotates about said hinge, so as to separate said edge element of said cabinet and said securing mechanism of said second arm, thereby the drawer unsecures and concomitantly opens.

7. The drawer-cabinet of claim 6, wherein said second arm includes a far end, said far end being curved, so as to permit smooth closing of said drawer.

8. The drawer-cabinet of claim 6, wherein said securing mechanism is a groove.

9. The drawer-cabinet of claim 6, wherein said first and second arms and said securing mechanism of said L-shaped element, said spring element and said hinge are all integrally formed with one another.

10. The drawer-cabinet of claim 6, wherein said drawer further includes a stopper to limit the rotation of said L-shaped element about said hinge.

* * * * *